US011475861B2

(12) United States Patent
Kim et al.

(10) Patent No.: US 11,475,861 B2
(45) Date of Patent: Oct. 18, 2022

(54) SCAN DRIVER AND DISPLAY DEVICE INCLUDING SCAN DRIVER

(71) Applicant: SAMSUNG DISPLAY CO., LTD., Yongin-si (KR)

(72) Inventors: Won Tae Kim, Yongin-si (KR); Hae Kwan Seo, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 27 days.

(21) Appl. No.: 16/804,795

(22) Filed: Feb. 28, 2020

(65) Prior Publication Data

US 2020/0327861 A1 Oct. 15, 2020

(30) Foreign Application Priority Data

Apr. 12, 2019 (KR) ..... 10-2019-0043233

(51) Int. Cl.
*G09G 5/00* (2006.01)

(52) U.S. Cl.
CPC ..... *G09G 5/003* (2013.01); *G09G 2310/067* (2013.01); *G09G 2330/028* (2013.01)

(58) Field of Classification Search
CPC ..... G09G 5/003; G09G 2330/028; G09G 2310/067; G09G 2310/0286; G09G 2310/04; G09G 2300/0842; G09G 2300/0819; G09G 2300/0861; G09G 3/3233; G09G 3/3266
See application file for complete search history.

(56) References Cited

U.S. PATENT DOCUMENTS

| | | | | |
|---|---|---|---|---|
| 9,972,265 | B2 | 5/2018 | Na et al. | |
| 10,049,617 | B2 | 8/2018 | Shin et al. | |
| 2001/0052887 | A1 | 12/2001 | Tsutsui et al. | |
| 2012/0242644 | A1* | 9/2012 | Liu | G09G 3/20 345/212 |
| 2016/0351160 | A1* | 12/2016 | In | G09G 3/3225 |
| 2017/0287425 | A1* | 10/2017 | Koo | G09G 3/3674 |

FOREIGN PATENT DOCUMENTS

| | | |
|---|---|---|
| JP | 4424872 | 12/2009 |
| KR | 10-0433020 | 5/2004 |
| KR | 10-2016-0045215 | 4/2016 |
| KR | 10-2017-0023359 | 3/2017 |

* cited by examiner

*Primary Examiner* — Alexander Eisen
*Assistant Examiner* — Kebede T Teshome
(74) *Attorney, Agent, or Firm* — F. Chau & Associates, LLC

(57) ABSTRACT

A display device includes a timing controller, a scan driver, a data driver, and a display unit. The timing controller generates a clock signal, a start signal, and image data. The scan driver includes a plurality of stages for sequentially outputting the clock signal as a scan signal in response to the start signal. The data driver generates a data signal using the image data. The display unit includes pixels for emitting light with a luminance corresponding to the data signal in response to the scan signal. The timing controller performs masking on the clock signal in a part of a first frame period during which the scan driver sequentially outputs the scan signal.

19 Claims, 11 Drawing Sheets

SCAN DRIVER AND DISPLAY DEVICE INCLUDING SCAN DRIVER

CROSS-REFERENCE TO RELATED APPLICATION

This application claims priority under 35 U.S.C. § 119 to Korean Patent Application No. 10-2019-0043233, filed in the Korean Intellectual Property Office on Apr. 12, 2019, the disclosure of which is incorporated by reference herein in its entirety.

TECHNICAL FIELD

Exemplary embodiments of the inventive concept relate to a scan driver and a display device including the scan driver.

DISCUSSION OF RELATED ART

A display device includes a display panel and a driver. The display panel includes scan lines, data lines, and pixels. The driver includes a scan driver that sequentially provides a scan signal to the scan lines, and a data driver that provides a data signal to the data lines. In response to the scan signal provided by corresponding scan lines, each of the pixels may emit light with a luminance corresponding to the data signal provided by corresponding data lines.

To reduce power consumption, the display device can display some frame images, or drive a specific area of the display panel. To drive only a specific area of the display panel, the scan driver may provide the scan signal to select only scan lines corresponding to the specific area. However, by modifying a circuit configuration of the scan driver to select only some of the scan lines, the circuit configuration may become complicated.

SUMMARY

A display device according to exemplary embodiments of the inventive concept includes a timing controller configured to generate a clock signal, a start signal, and image data, a scan driver including a plurality of stages configured to sequentially output the clock signal as a scan signal in response to the start signal, a data driver configured to generate a data signal using the image data, and a display unit including pixels for emitting light with a luminance corresponding to the data signal in response to the scan signal. The timing controller performs masking on the clock signal in a part of a first frame period during which the scan driver sequentially outputs the scan signal.

According to an exemplary embodiment of the inventive concept, each of the plurality of stages may output the clock signal as the scan signal in response to a carry signal, a first stage of the plurality of stages may receive the start signal as the carry signal, and stages other than the first stage of the plurality of stages may receive a scan signal of a previous stage as the carry signal.

According to an exemplary embodiment of the inventive concept, the clock signal may include a first clock signal and a second clock signal, the first clock signal may have a pulse waveform, and the second clock signal may be a signal in which the first clock signal is shifted by a half-cycle.

According to an exemplary embodiment of the inventive concept, the first stage may output the second clock signal as the scan signal, and a second stage of the plurality of stages may output the first clock signal as the scan signal, where the second stage is adjacent to the first stage.

According to an exemplary embodiment of the inventive concept, the timing controller may perform masking on at least one of the first clock signal and the second clock signal in the part of the first frame period.

According to an exemplary embodiment of the inventive concept, the timing controller may perform masking on the second clock signal, and may not perform masking on the first clock signal in the part of the first frame period.

According to an exemplary embodiment of the inventive concept, the second clock signal may have a pulse having a first voltage level between a first time point and a second time point, the second clock signal may be maintained at a second voltage level that is different from the first voltage level between a third time point and a fourth time point, the first time point, the second time point, the third time point, and the fourth time point may be sequentially separated by a half-cycle of the second clock signal, and the third time point and the fourth time point may be included in the part of the first frame period.

According to an exemplary embodiment of the inventive concept, the first clock signal may have a pulse having the first voltage level between the second time point and the third time point and a pulse having the first voltage level between the fourth time point and a fifth time point, and the fifth time point may be separated from the fourth time point by a half-cycle of the first clock signal.

According to an exemplary embodiment of the inventive concept, the part of the first frame period may correspond to at least one of the plurality of stages.

According to an exemplary embodiment of the inventive concept, the part of the first frame period may be smaller than a cycle of the first clock signal.

According to an exemplary embodiment of the inventive concept, the at least one of the plurality of stages may output the scan signal having a turn-off voltage level, and the turn-off voltage level may be a voltage level that turns off a transistor, where the transistor is included in each of the pixels and receives the scan signal.

According to an exemplary embodiment of the inventive concept, the first stage may include a first node controller configured to transmit the carry signal to a first node in response to the first clock signal and the second clock signal, and a buffer unit configured to output the second clock signal as the scan signal in response to a first node voltage of the first node.

According to an exemplary embodiment of the inventive concept, the first stage may further include a second node controller configured to transmit the first clock signal to a second node in response to the first node voltage of the first node, and the buffer unit may transition a voltage level of the scan signal to a turn-off voltage level in response to a second node voltage of the second node.

According to an exemplary embodiment of the inventive concept, the timing controller may perform masking on the clock signal in a first period of the first frame period, and perform masking on the clock signal in a second period of the second frame period, and a first position of the second period of the second frame period may be different from a second position of the first period of the first frame period.

According to an exemplary embodiment of the inventive concept, the timing controller may shift and output the image data based on a difference between the first position and the second position.

According to an exemplary embodiment of the inventive concept, the data driver may cut off output of the data signal in the other part of the first frame period after the part of the first frame period.

A scan driver according to exemplary embodiments of the inventive concept includes a first clock signal line, a second clock signal line, a masking unit configured to transmit a first clock signal and a second clock signal to the first clock signal line and the second clock signal line, respectively, where the masking unit partially performs masking on at least one of the first clock signal and the second clock signal, and a plurality of stages connected to the first clock signal line and the second clock signal line, and configured to sequentially output a scan signal using the first clock signal and the second clock signal. Each of the plurality of stages outputs one of the first clock signal and the second clock signal as the scan signal in response to a carry signal, and each of the plurality of stages receives a scan signal of a previous stage as the carry signal.

According to an exemplary embodiment of the inventive concept, the masking unit may include a switching element including a first electrode, a second electrode, and a gate electrode. The first electrode receives the second clock signal, the second electrode is connected to the second clock signal line, and the gate electrode receives a masking control signal.

A method of operating a display device according to exemplary embodiments of the inventive concept includes outputting, to a scan driver, a first clock signal and a second clock signal, where the first clock signal has a pulse waveform and the second clock signal is a signal in which the first clock signal is shifted by a half-cycle, controlling, by a timing controller, the second clock signal to have a pulse having a first voltage level between a first time point and a second time point, controlling, by the timing controller, the first clock signal to have a pulse having the first voltage level between the second time point and a third time point, masking, by the timing controller, the second clock signal to maintain the second clock signal at a second voltage level that is different from the first voltage level between the third time point and a fourth time point, and controlling, by the timing controller, the first clock signal to have a pulse having the first voltage level between the fourth time point and a fifth time point. The first time point, the second time point, the third time point, the fourth time point, and the fifth time point are sequentially separated by a half-cycle of the first clock signal.

According to an exemplary embodiment of the inventive concept, a scan signal output by the scan driver is maintained at a turn-off voltage level in response to the second clock signal between the third time point and the fourth time point.

DETAILED DESCRIPTION OF THE EMBODIMENTS

Figure 1:
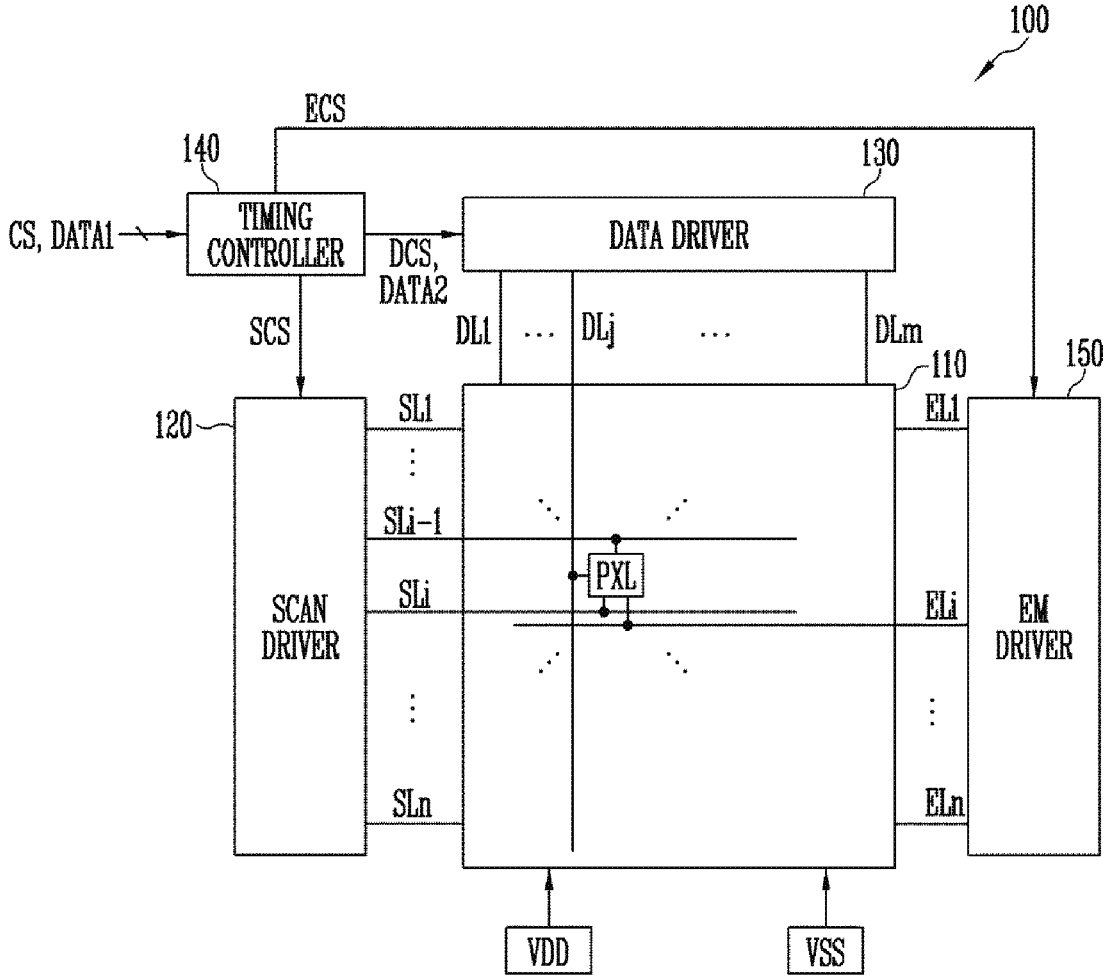
FIG. 1 is a block diagram of a display device according to an exemplary embodiment of the inventive concept.

Exemplary embodiments of the inventive concept provide a scan driver and a display device including the scan driver that can prevent a complicated circuit configuration of the scan driver and can reduce power consumption by driving only a specific area of the display panel.

Exemplary embodiments of the inventive concept will be described more fully hereinafter with reference to the accompanying drawings. Like reference numerals may refer to like elements throughout this application.

FIG. 1 is a block diagram of a display device according to an exemplary embodiment of the inventive concept.

Referring to FIG. 1, a display device 100 may include a display unit 110, a scan driver (or gate driver) 120, a data driver (or source driver) 130, a timing controller 140, and an emission driver 150.

The display unit 110 may include scan lines (or gate lines) SL1 to SLn (where n is a positive integer), data lines DL1 to DLm (where m is a positive integer), and light emission control lines EL1 to ELn, and a pixel PXL. The pixel PXL may be disposed in an area (for example, pixel area) that is partitioned by the scan lines SL1 to SLn, the data lines DL1 to DLm, and the light emission control lines EL1 to ELn.

The pixel PXL may be connected to at least one of the scan lines SL1 to SLn, at least one of the data lines DL1 to DLm, and at least one of the light emission control lines EL1 to Eln. For example, the pixel PXL may be connected to a scan line SLi, a previous scan line SLi−1 adjacent to the scan line SLi, a data line DLj, and a light emission control line Eli (where i and j are positive integers).

The pixel PXL may be initialized in response to a scan signal provided by the previous scan line SLi−1 (a scan signal or a previous gate signal provided at a previous time point), stores or write a data signal provided by the data line DLj in response to the scan signal provided by the scan line SLi (a scan signal or a gate signal provided at a current time point), and may emit light with luminance corresponding to the stored data signal in response to a light emission control signal provided by the light emission control line Eli.

First and second power supply voltages VDD and VSS may be provided to the display unit 110. The first and second power supply voltages VDD and VSS are required to operate the pixel PXL, and the first power supply voltage VDD may have a higher voltage level than that of the second power supply voltage VSS.

The scan driver 120 may generate the scan signal based on a scan control signal SCS, and may sequentially provide the scan signal to the scan lines SL1 to SLn. In this case, the scan control signal SCS may include a start signal, a clock signal, and the like, and may be provided from the timing controller 140. For example, the scan driver 120 may include a shift register (or stage) that sequentially generates and outputs a pulse-type scan signal corresponding to a pulse-type start signal by using clock signals.

A specific configuration of the scan driver 120 will be described later with reference to FIG. 4.

The emission driver 150 may generate a light emission control signal based on a light emission driving control signal ECS, and sequentially or simultaneously provide the light emission control signal to the light emission control lines EL1 to ELn. In this case, the light emission driving control signal ECS may include a light emission start signal, light emission clock signals, and the like, and may be provided from the timing controller 140. For example, the emission driver 150 may include a shift register that uses the light emission clock signals to sequentially generate and output a pulse-type light emission control signal corresponding to a pulse-type light emission start signal.

The data driver 130 may generate data signals based on image data DATA2 and a data control signal DCS that are provided from the timing controller 140, and provide the data signals to the display unit 110 (or the pixel PXL). In this case, the data control signal DCS controls the operation of the data driver 130, and may include a load signal (or data enable signal) that indicates the output of a valid data signal.

In exemplary embodiments of the inventive concept, the data driver 130 may cut off output of the data signal in a part of one frame period. In this case, one frame period may be a period during which one frame image is displayed. A time point at which the data driver 130 cuts off the output of the data signal will be described later with reference to FIG. 10.

The timing controller 140 may receive input image data DATA1 and a control signal CS from the outside (e.g., a graphic processor), generate the scan control signal SCS and the data control signal DCS based on the control signal CS, and transform the input image data DATA1 to generate image data DATA2. For example, the timing controller 140 may convert the input image data DATA1 in RGB format into the image data DATA2 in RGBG format according to a pixel arrangement in the display unit 110.

In an exemplary embodiment of the inventive concept, the timing controller 140 may perform masking on at least one of the clock signals in a part of one frame period. For example, a first clock signal of the clock signals has a first voltage level (e.g., a turn-off voltage level at which a switching element or a transistor is turned off) but has a pulse waveform that is periodically transitioned to a second voltage level (e.g., a turn-on voltage level at which a switching element or a transistor is turned on), and the timing controller 140 may skip the transition of the first clock signal to the second voltage level in the part of one frame period. In other words, the first clock signal has pulses that periodically have a turn-on voltage level, and the timing controller 140 may mask or remove at least one pulse of the first clock signal in the part of one frame period. Therefore, the first clock signal may have the first voltage level instead of the second voltage level in the part of one frame period.

In this case, the scan driver 120 may sequentially output a pulse-type scan signal having the second voltage level before the part of one frame period, and output a scan signal having only the first voltage level in the part of one frame period (and after the part of one frame period). Therefore, only pixels in an area of the display unit 110 (e.g., an area corresponding to a period before the part of one frame period) may be selected for light emission.

By masking only at least one of the clock signals of the timing controller 140, the scan signal (e.g., the pulse-type scan signal having the second voltage level) may be applied to only some of the scan lines SL1 to SLn. Therefore, the display device 100 may provide the scan signal only to some of the scan lines SL1 to SLn, partially drive the display unit 110, and reduce power consumption without an additional circuit or without modification to the scan driver 120.

At least one of the scan driver 120, the data driver 130, the timing controller 140, and the emission driver 150 may be formed on the display unit 110, or may be implemented as an integrated circuit (IC) to be connected to the display unit 110 in a tape carrier package form. In addition, at least two of the scan driver 120, the data driver 130, the timing controller 140, and the emission driver 150 may be implemented as a single IC.

Figure 2:
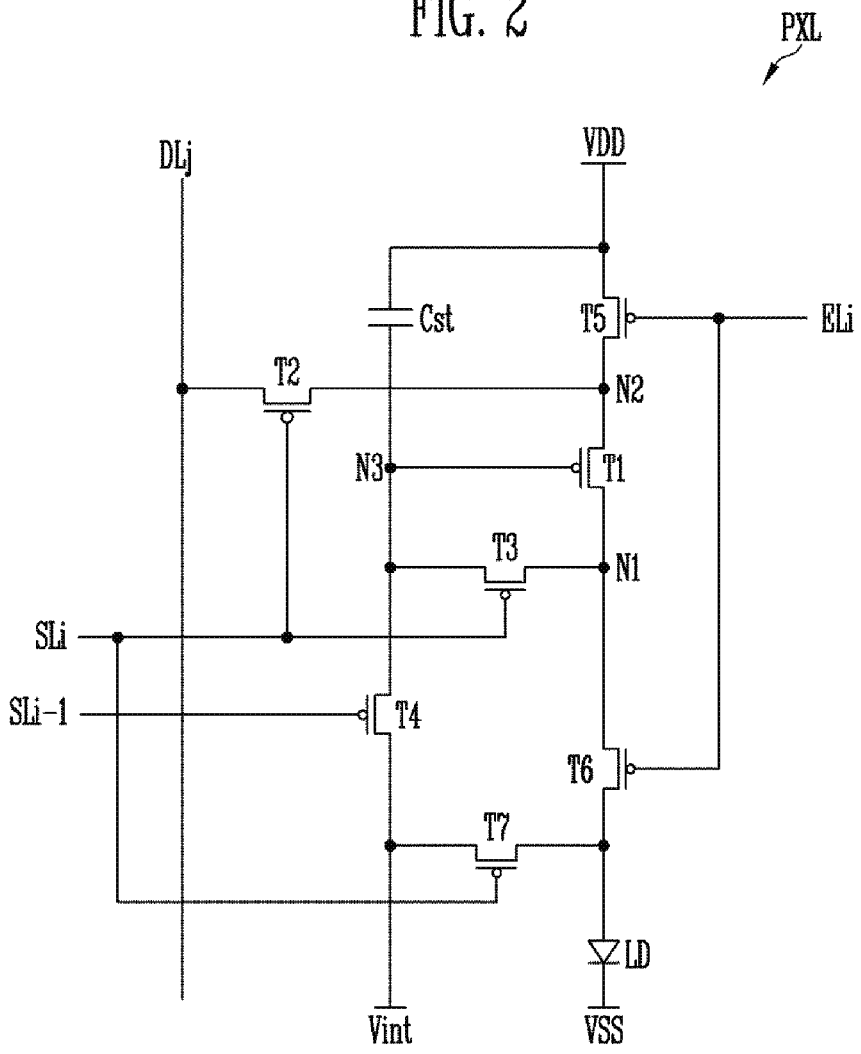
FIG. 2 is a circuit diagram of a pixel included in the display device of FIG. 1 according to an exemplary embodiment of the inventive concept.

FIG. 2 is a circuit diagram of a pixel included in the display device of FIG. 1 according to an exemplary embodiment of the inventive concept.

Referring to FIG. 2, the pixel PXL may include first to seventh transistors T1 to T7, a storage capacitor Cst, and a light-emitting element LD.

Each of the first to seventh transistors T1 to T7 may be implemented as a P-type transistor, but the inventive concept is not limited thereto. For example, at least some of the first to seventh transistors T1 to T7 may also be implemented as an N-type transistor.

A first electrode of the first transistor T1 (a driving transistor) may be connected to a second node N2, and may be connected to a first power supply line (e.g., a power supply line for transmitting the first power supply voltage VDD) through the fifth transistor T5. A second electrode of the first transistor T1 may be connected to a first node N1, and may be connected to anode of the light-emitting element LD through the sixth transistor T6. A gate electrode of the first transistor T1 may be connected to a third node N3. The first transistor T1 may control, according to a voltage of the third node N3, an amount of current flowing to a second power supply line (e.g., a power supply line for transmitting the second power supply voltage VSS) from the first power supply line through the light-emitting element LD.

The second transistor T2 may be connected between the data line DLj and the second node N2. A gate electrode of the second transistor T2 may be connected to the scan line SLi. The second transistor T2 may be turned on to electrically connect the data line DLj and the first electrode of the first transistor T1 when the scan signal is provided to the scan line SLi.

The third transistor T3 may be connected between the first node N1 and a third node N3. A gate electrode of the third transistor T3 may be connected to the scan line SLi. The third transistor T3 may be turned on to electrically connect the first node N1 and the third node N3 when the scan signal is provided to the scan line SLi. Therefore, when the third transistor T3 is turned on, the first transistor T1 may be diode-connected.

The storage capacitor Cst may be connected between the first power supply line and the third node N3. The storage capacitor Cst may store a data signal and a voltage corresponding to a threshold voltage of the first transistor T1.

The fourth transistor T4 may be connected between the third node N3 and an initialization power supply line (e.g., a power supply line for transmitting an initialization power supply voltage Vint). A gate electrode of the fourth transistor T4 may be connected to the previous scan line SLi−1. The fourth transistor T4 may be turned on to provide the initialization power supply voltage Vint to the first node N1 when the scan signal is provided to the previous scan line SLi−1. In this case, the initialization power supply voltage Vint may be set to have a voltage level that is lower than that of the data signal.

The fifth transistor T5 may be connected between the first power supply line and the second node N2. A gate electrode of the fifth transistor T5 may be connected to the light emission control line ELi. The fifth transistor T5 may be turned off when the light emission control signal is provided to the light emission control line Eli, and may be turned on in other cases.

The sixth transistor T6 may be connected between the first node N1 and the light-emitting element LD. A gate electrode of the sixth transistor T6 may be connected to the light emission control line ELi. The sixth transistor T6 may be turned off when the light emission control signal is provided to the light emission control line Eli, and may be turned on in other cases.

The seventh transistor T7 may be connected between the initialization power supply line and anode of the light-emitting element LD. A gate electrode of the seventh transistor T7 may be connected to the scan line SLi. The seventh transistor T7 may be turned on to provide the initialization power supply voltage Vint to the anode of the light-emitting element LD when the scan signal is provided to the scan line SLi.

The anode of the light-emitting element LD may be connected to the first transistor T1 via the sixth transistor T6, and a cathode thereof may be connected to the second power supply line. The light-emitting element LD may generate light with a predetermined luminance according to a current provided from the first transistor T1. The first power supply voltage VDD may be set to have a voltage level higher than that of the second power supply voltage VSS such that the current flows to the light-emitting element LD.

Figure 3:
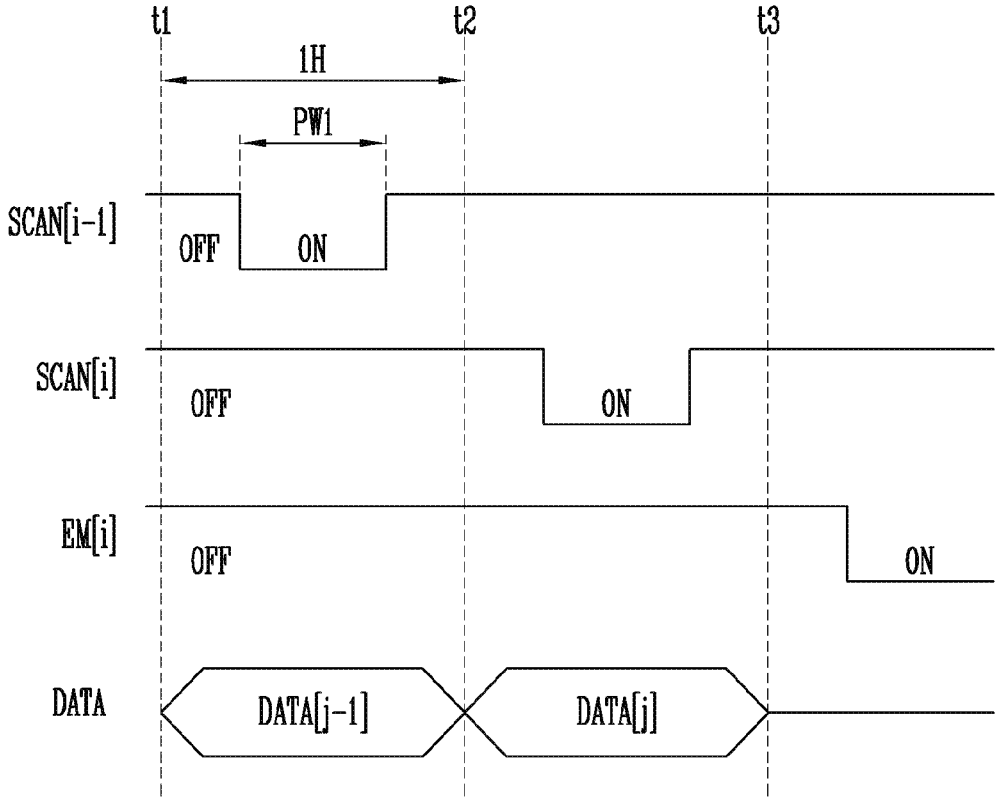
FIG. 3 is a waveform diagram of signals measured from the pixel of FIG. 2 according to an exemplary embodiment of the inventive concept.

FIG. 3 is a waveform diagram of signals measured from pixels of FIG. 2 according to an exemplary embodiment of the inventive concept. FIG. 3 shows, in one frame period, a previous scan signal SCAN[i−1] provided to the previous scan line SLi−1, a scan signal SCAN[i] provided to the scan line SLi, a light emission control signal EM[i] provided to the light emission control line ELi, and a data signal DATA provided to the data line DLj.

Referring to FIG. 2 and FIG. 3, between a first time point t1 and a second time point t2, the previous scan signal SCAN[i−1] may be transitioned from a turn-off voltage level to a turn-on voltage level, and may be transitioned back to the turn-off voltage level. A first pulse width PW1 in which the previous scan signal SCAN[i−1] has a turn-on voltage level may be smaller than one horizontal period (1H).

In response to the previous scan signal SCAN[i−1] having the turn-on voltage level, the fourth transistor T4 is turned on, and the third node N3 or the storage capacitor Cst may be initialized by the initialization power supply voltage Vint. Therefore, the period of time between the first time point t1 and the second time point t2 may be referred to as an initialization period.

Between the second time point t2 and a third time point t3, the scan signal SCAN[i] may be transitioned from a turn-off voltage level to a turn-on voltage level, and may be transitioned back to the turn-off voltage level.

In response to the scan signal SCAN[i] having the turn-on voltage level, the second transistor T2 and the third transistor T3 are turned on, and the data signal (e.g., a data signal DATA[j] corresponding to the scan signal SCAN[i]) may be stored in the storage capacitor Cst. Therefore, the period of time between the second time point t2 and the third time point t3 may be referred to as a writing period.

In addition, between the second time point t2 and the third time point t3, in response to the scan signal SCAN[i] having the turn-on voltage level, the seventh transistor T7 is turned on, and the anode of the light-emitting element LD may be initialized by the initialization power supply voltage Vint.

After the third time point t3, the light emission control signal EM[i] may be transitioned from a turn-off voltage level to a turn-on voltage level.

In response to the light emission control signal EM[i] having the turn-on voltage level, the fifth transistor T5 and the sixth transistor T6 are turned on, a current corresponding to a voltage level of the third node N3 (e.g., the data signal DATA[j] corresponding to the scan signal SCAN[i]) is provided to the light-emitting element LD from the first power supply line, and the light-emitting element LD may emit light with luminance corresponding to the current. Therefore, the period of time after the third time point t3 in one frame period may be referred to as a light-emitting period.

Figure 4:
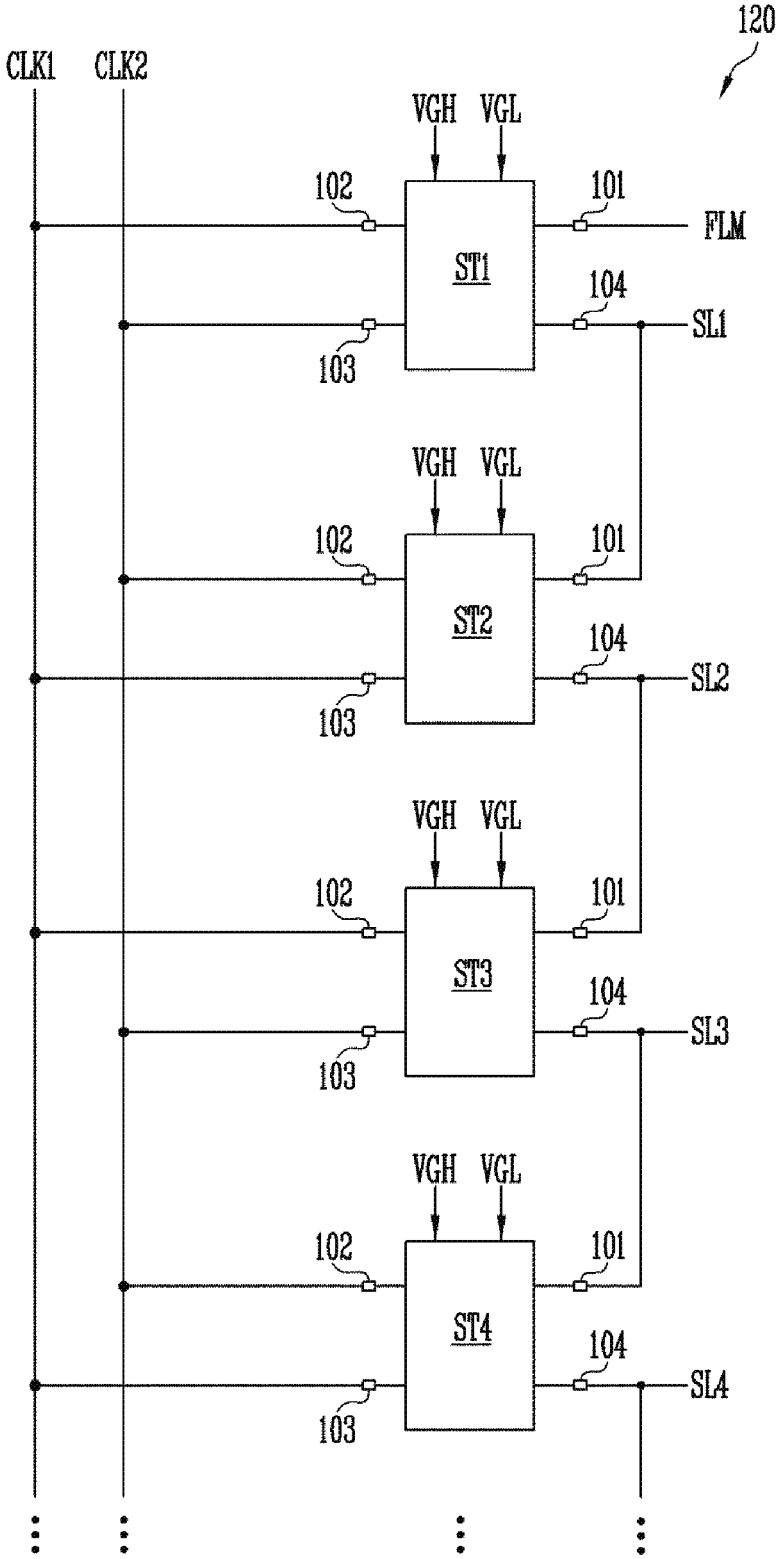
FIG. 4 is a block diagram of a scan driver included in the display device of FIG. 1 according to an exemplary embodiment of the inventive concept.

FIG. 4 is a block diagram of a scan driver included in the display device of FIG. 1 according to an exemplary embodiment of the inventive concept.

Referring to FIG. 4, the scan driver 120 may include stages ST1 to ST4 (scan stages or scan stage circuits). The stages ST1 to ST4 may be respectively connected to the corresponding scan lines SL1 to SL4, and may be connected together to clock signal lines (e.g., signal lines for transmitting first and second clock signals CLK1 and CLK2). The stages ST1 to ST4 may have substantially the same circuit structure.

Each of the stages ST1 to ST4 may include a first input terminal 101, a second input terminal 102, a third input terminal 103, and an output terminal 104.

The first input terminal 101 may receive a carry signal. In this case, the carry signal may include a start signal FLM (or a start pulse) or an output signal (e.g., a scan signal) of a previous stage. For example, the first input terminal 101 of the first stage ST1 receives the start signal FLM, and the first input terminals 101 of the other stages ST2 to ST4 receive scan signals of the previous stages. In other words, the scan signal of a previous stage of a corresponding stage may be provided to the corresponding stage as the carry signal.

The second input terminal 102 of the first stage ST1 may be connected to a first clock signal line to receive the first clock signal CLK1, and the third input terminal 103 of the first stage ST1 may be connected to a second clock signal line to receive the second clock signal CLK2. The second input terminal 102 of the second stage ST2 may be connected to the second clock signal line to receive the second clock signal CLK2, and the third input terminal 103 of the second stage ST2 may be connected to the first clock signal line to receive the first clock signal CLK1. Similar to the first stage ST1, the second input terminal 102 of the third stage ST3 may be connected to the first clock signal line to receive the first clock signal CLK1, and the third input terminal 103 of the third stage ST3 may be connected to the second clock signal line to receive the second clock signal CLK2. Similar to the second stage ST2, the second input terminal 102 of the fourth stage ST4 may be connected to the second clock signal line to receive the second clock signal CLK2, and the third input terminal 103 of the fourth stage ST4 may be connected to the first clock signal line to receive the first clock signal CLK1. In other words, the first clock signal line and the second clock signal line may be alternately connected to the second input terminal 102 and the third input terminal 103 of each stage, or the first clock signal CLK1 and the second clock signal CLK2 may be alternately provided to the second input terminal 102 and the third input terminal 103 of each stage.

As will be described later, pulses of the first clock signal CLK1 provided by the first clock signal line and pulses of the second clock signal CLK2 provided by the second clock signal line may not overlap one another in time. In this case, each of the pulses may be at a turn-on voltage level.

The stages ST1 to ST4 may receive a first voltage VGH (or a high voltage level) and a second voltage VGL (or a low voltage level). The first voltage VGH may be set to a turn-off voltage level, and the second voltage VGL may be set to a turn-on voltage level.

Figure 5:
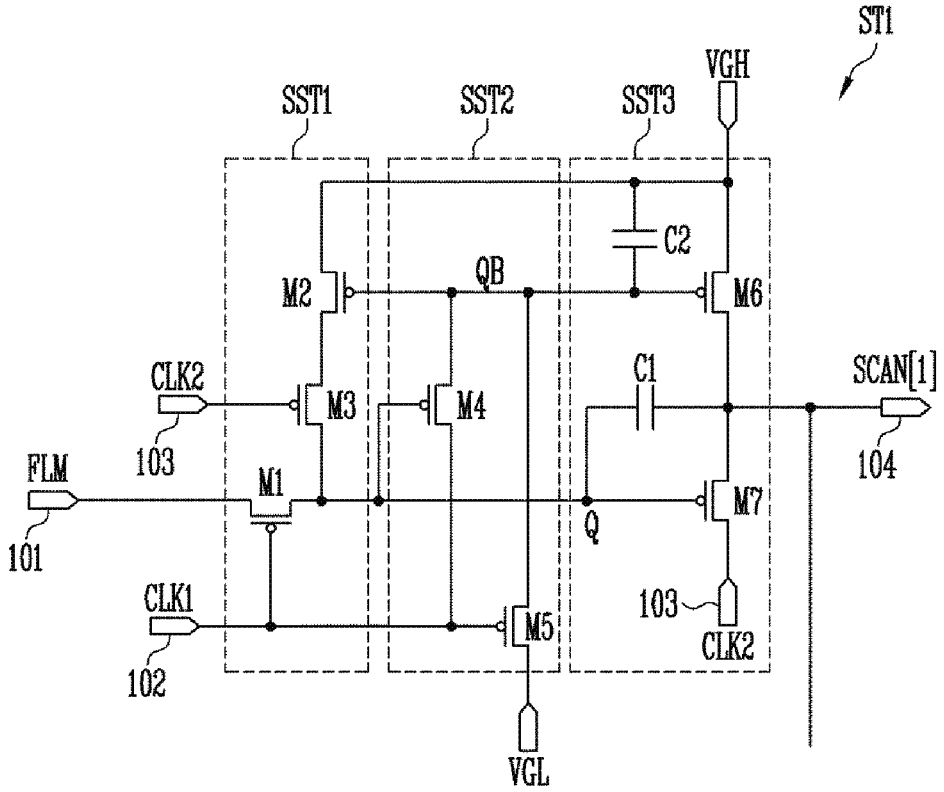
FIG. 5 is a circuit diagram of a first stage included in the scan driver of FIG. 4 according to an exemplary embodiment of the inventive concept.

FIG. 5 is a circuit diagram of a first stage included in the scan driver of FIG. 4 according to an exemplary embodiment of the inventive concept. Since the stages ST1 to ST4 shown in FIG. 4 are substantially the same as one another except for a configuration for receiving the first and second clock signals CLK1 and CLK2, only the first stage ST1 will be described.

Referring to FIG. 4 and FIG. 5, the first stage ST1 may include a first node controller SST1, a second node controller SST2, and a buffer unit SST3.

The first node controller SST1 may transmit the start signal FLM (or a carry signal) or the first voltage VGH to a first node Q based on the first clock signal CLK1 and the second clock signal CLK2. The first node controller SST1 may include a first switching element M1, a second switching element M2, and a third switching element M3.

The first switching element M1 may include a first electrode that is connected to the first input terminal 101 to receive the start signal FLM (or the carry signal), a second electrode that is connected to the first node Q, and a gate electrode that is connected to the second input terminal 102 to receive the first clock signal CLK1.

The second switching element M2 may include a first electrode that receives the first voltage VGH, a second electrode that provides the first voltage VGH to the first node Q, and a gate electrode that receives a signal of a second node QB.

The third switching element M3 may include a first electrode that is connected to the second electrode of the second switching element M2, a second electrode that is connected to the first node Q, and a gate electrode that is connected to the third input terminal 103 to receive the second clock signal CLK2. In this case, the second and third switching elements M2 and M3 may be connected in series to each other.

The second node controller SST2 may transmit the second voltage VGL lower than the first clock signal CLK1 to the second node QB based on the first clock signal CLK1 and a signal (or a voltage level) of the first node Q. The second node controller SST2 may include a fourth switching element M4 and a fifth switching element M5.

The fourth switching element M4 may include a first electrode that receives the first clock signal CLK1, a second electrode that is connected to the second node QB, and a gate electrode that receives the signal of the first node Q.

The fifth switching element M5 may include a first electrode that receives the second voltage VGL, a second electrode that is connected to the second node QB, and a gate electrode that receives the first clock signal CLK1.

The buffer unit SST3 may output, based on the signal of the first node Q and a signal of the second node QB, a first scan signal SCAN[1] that includes the second clock signal CLK2 as the pulse. In other words, the buffer unit SST3 may output the second clock signal CLK2 as the first scan signal SCAN[1] based on the signal of the first node Q and the signal of the second node QB. The first scan signal SCAN[1] may be provided as the carry signal to the second stage ST2 (or the next stage) (refer to FIG. 4).

The buffer unit SST3 may include a sixth switching element M6 (or a pull-up switching element) and a seventh switching element M7 (or a pull-down switching element). The sixth switching element M6 may include a first electrode that receives the first voltage VGH, a second electrode that is connected to the output terminal 104, and a gate electrode that is connected to the second node QB.

The seventh switching element M7 may include a first electrode that is connected to the output terminal 104, a second electrode that receives the second clock signal CLK2, and a gate electrode that is connected to the first node Q.

The buffer unit SST3 may further include a first capacitor C1 and a second capacitor C2.

The first capacitor C1 may be connected between the first electrode of the seventh switching element M7 and the gate electrode of the seventh switching element M7.

The second capacitor C2 may be connected between the first electrode of the sixth switching element M6 and the gate electrode of the sixth switching element M6.

In FIG. 5, the first to seventh switching elements M1 to M7 are shown as P-type transistors, but this is only an example, and is therefore not limited thereto. For example, the first to seventh switching elements M1 to M7 may also be implemented as N-type transistors.

Figure 6:
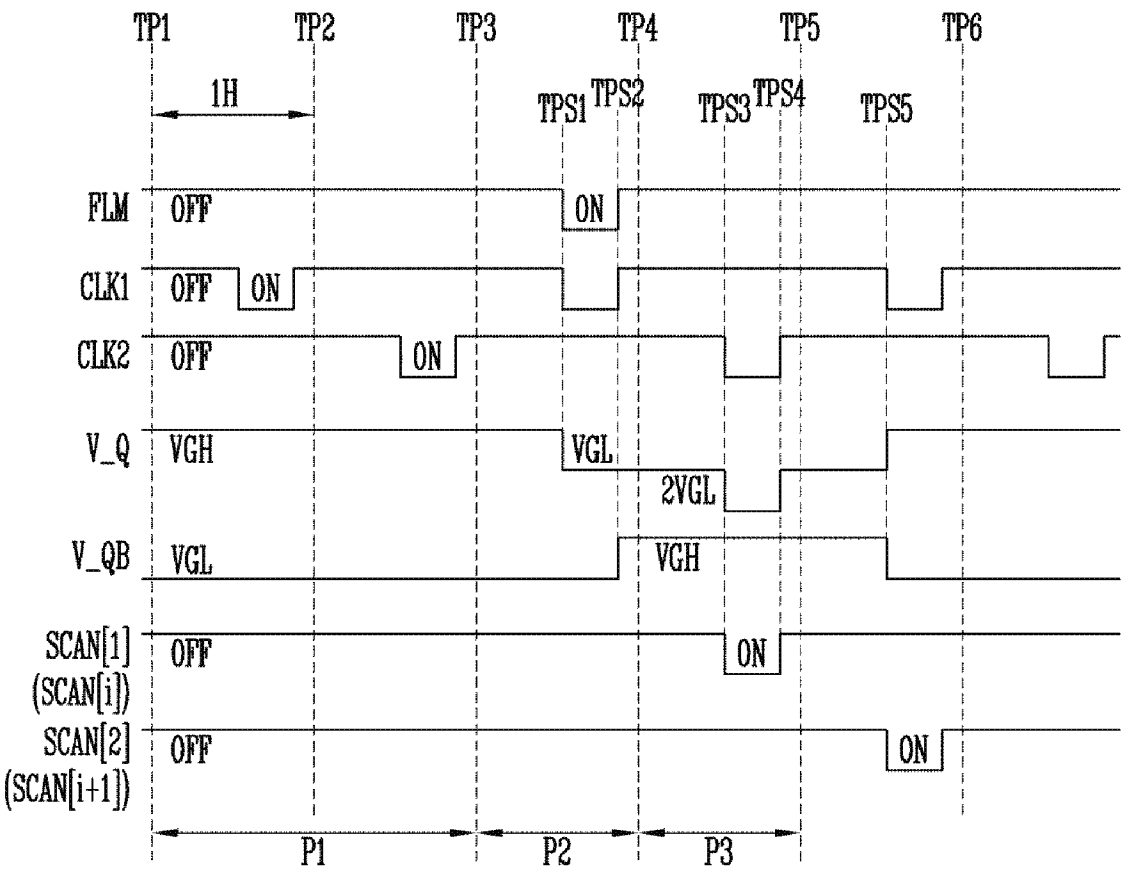
FIG. 6 is a waveform diagram of signals measured at the first stage of FIG. 5 according to an exemplary embodiment of the inventive concept.

FIG. 6 is a waveform diagram of signals measured at the first stage of FIG. 5 according to an exemplary embodiment of the inventive concept. In FIG. 6, first to sixth time points TP1 to TP6 are set at intervals of one horizontal period (1H).

Referring to FIG. 5 and FIG. 6, between the first time point TP1 and the second time point TP2, the first clock signal CLK1 may be transitioned from a turn-off voltage level to a turn-on voltage level, and may be transitioned back to the turn-off voltage level. In other words, between the first time point TP1 and the second time point TP2, the first clock signal CLK1 may have a pulse having the turn-on voltage level. The width of the pulse of the first clock signal CLK1 having the turn-on voltage level may be substantially the same as the first pulse width PW1 described with reference to FIG. 3.

Next, between the second time point TP2 and the third time point TP3, the second clock signal CLK2 may be transitioned from a turn-off voltage level to a turn-on voltage level, and may be transitioned back to the turn-off voltage level. In other words, between the second time point TP2 and the third time point TP3, the second clock signal CLK2 may have a pulse having the turn-on voltage level.

The first clock signal CLK1 and the second clock signal CLK2 have the same cycle (for example, two horizontal periods), and a pulse of the second clock signal CLK2 may appear one horizontal period (1H) after the pulse of the first clock signal CLK1 appears. In other words, the second clock signal CLK2 may be a signal in which the first clock signal CLK1 is shifted by one horizontal period (1H) (or a half-cycle of the first clock signal CLK1).

In a first period of time P1 between the first time point TP1 and the third time point TP3, the start signal FLM may be maintained at a turn-off voltage level. In other words, the first period of time P1 may be referred to as an initialization period before the start signal FLM is applied.

In a second period of time P2 between the third time point TP3 and the fourth time point TP4, the start signal FLM may have a pulse having a turn-on voltage level. For example, in a first sub-time point TPS1, the start signal FLM may be transitioned from a turn-off voltage level to a turn-on voltage level, and in a second sub-time point TPS2, the start signal FLM may be transitioned from the turn-on voltage level to the turn-off voltage level.

The first clock signal CLK1 may also have a pulse having the turn-on voltage level.

In this case, the first switching element M1 may be turned on in response to the first clock signal CLK1, and may transmit the start signal FLM to the first node Q. Therefore, the first node Q (V_Q) may have a turn-on voltage level (or the second voltage VGL) according to the start signal FLM.

The seventh switching element M7 is turned on in response to a signal of the first node Q (V_Q), and pulls down the first scan signal SCAN[1] (or the scan signal SCAN[i]), and the second clock signal CLK2 may be output as the first scan signal SCAN[1].

However, because the second clock signal CLK2 has the turn-off voltage level, the first scan signal SCAN [1] may have the turn-off voltage level.

The first capacitor C1 may store a voltage difference between a turn-off voltage level and a turn-on voltage level according to the signal of the first node Q (V_Q) (e.g., the voltage level of the first node Q) and the first scan signal SCAN[1].

The fifth switching element M5 may be turned on in response to the first clock signal CLK1, and may transmit the second voltage VGL to the second node QB. Therefore, the second node QB may have the second voltage VGL (or a turn-on voltage level).

In other words, in the second period of time P2, the first stage ST1 may prepare to output the first scan signal SCAN[1] in response to the start signal FLM (or the previous gate signal). The second period of time P2 may be referred to as a preparing period (or a detection period of the start signal FLM) during which the first stage ST1 prepares to output the scan signal.

In a third period of time P3 between the fourth time point TP4 and the fifth time point TP5, the second clock signal CLK2 may have a pulse having a turn-on voltage level. For example, in a third sub-time point TPS3, the second clock signal CLK2 may be transitioned from the turn-off voltage level to the turn-on voltage level, and in a fourth sub-time point TPS4, the second clock signal CLK2 may be transitioned from the turn-on voltage level to the turn-off voltage level.

In this case, because the first capacitor C1 causes the first node Q to have the turn-on voltage level, the seventh switching element M7 may be maintained at a turn-on state in response to the signal of the first node Q (V_Q). Therefore, the first scan signal SCAN[1] may have a turn-on voltage level according to the second clock signal CLK2. The first node Q (V_Q) may have a voltage level 2VGL (e.g., a second turn-on voltage level) lower than the turn-on voltage level due to the bootstrap of the first capacitor C1.

The fourth switching element M4 is turned on in response to the signal of the first node Q (V_Q), and may transmit the first clock signal CLK1 to the second node QB. Therefore, the second node QB may have the turn-off voltage level (or the first voltage VGH) according to the first clock signal CLK1 having the turn-off voltage level.

In other words, in the third period of time T3, the first stage ST1 outputs the first scan signal SCAN[1] having the turn-on voltage level, and the third period of time T3 may be referred to as an output period.

The second stage ST2 (refer to FIG. 4) that receives the first scan signal SCAN[1] of the first stage ST1 as a carry signal may prepare to output a second scan signal SCAN[2] (or a scan signal SCAN[i+1]) in response to the first scan signal SCAN[1] having the turn-on voltage level.

Subsequently, between the fifth time point TP5 and the sixth time point TP6, the first clock signal CLK1 may have a pulse having the turn-on voltage level.

At a fifth sub-time point TPS5, the first switching element M1 is turned on in response to the first clock signal CLK1, and the first node Q may be connected to the first input terminal 101. Between the fifth time point TP5 and the sixth time point TP6, because the start signal FLM having the turn-off voltage level is applied to the first input terminal 101, the first node Q (V_Q) may be transitioned to the turn-off voltage level (or the first voltage VGH).

In addition, the fifth switching element M5 is turned on in response to the first clock signal CLK1, and the second voltage VGL may be transmitted to the second node QB. The sixth switching element M6 is turned on in response to a signal of the second node QB (V_QB), and pulls up the first scan signal SCAN[1] (or the scan signal SCAN[i]), and the first voltage VGH may be output as the first scan signal SCAN[1].

The second stage ST2 (refer to FIG. 4) operates in the same or similar way as the first stage ST1 in the third period of time P3, and may output the second scan signal SCAN[2] having a turn-on voltage level.

Subsequently, at intervals of one horizontal period (1H), the next stages (e.g., the third stage ST3 and the fourth stage ST4 described with reference to FIG. 4) may sequentially output the scan signals.

Figure 7:
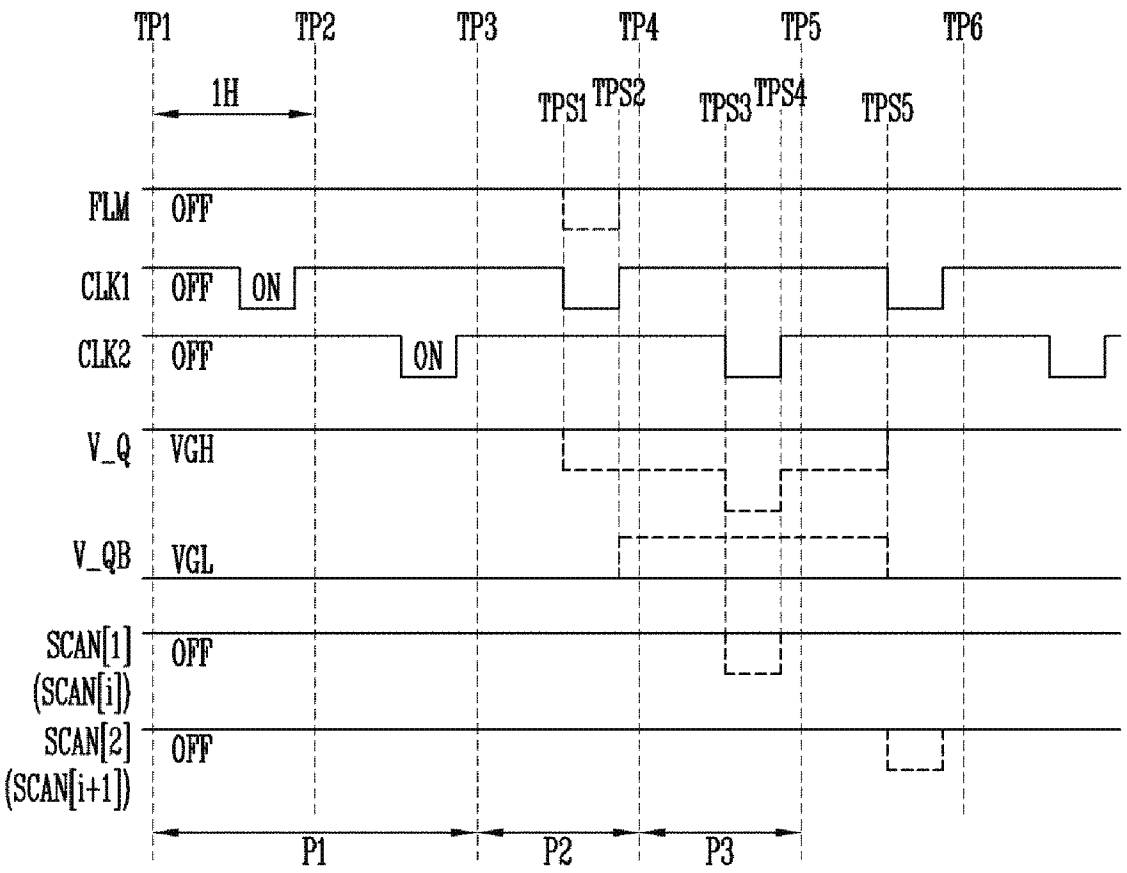
FIG. 7 is a waveform diagram of signals measured at the first stage of FIG. 5 according to a comparative example.

FIG. 7 is a waveform diagram of signals measured at the first stage of FIG. 5 according to a comparative example. FIG. 7 shows a waveform diagram that corresponds to the waveform diagram of FIG. 6, and the waveform diagram of FIG. 6 is shown by a dotted line.

Referring to FIG. 5 to FIG. 7, between the third time point TP3 and the a fourth time point TP4, the start signal FLM does not have a pulse having a turn-on voltage level, and may be maintained at a turn-off voltage level. For example, the timing controller 140 described with reference to FIG. 1 may skip the start signal FLM, and provide the start signal FLM having a turn-off voltage level.

In this case, the first stage ST1 may be operated in substantially the same way as in the period of time between the first time point TP1 and the second time TP2. Therefore, a signal of the first node Q (V_Q) may be maintained at a turn-off voltage level (or the first voltage VGH), and a signal of the second node QB (V_QB) may be maintained at a turn-on voltage level (or the second voltage VGL).

According to the operation of the first stage ST1 between the third time point TP3 and the fourth time point TP4, at the fourth time point TP4 and the fifth time point TP5, the first stage ST1 may be operated in substantially the same way as in the period of time between the second time point TP2 and the third time point TP3. Therefore, the signal of the first node Q (V_Q) may be maintained at the turn-off voltage level (or the first voltage VGH), and the signal of the second node QB (V_QB) may also be maintained at the turn-on voltage level (or the second voltage VGL). Therefore, the first scan signal SCAN[1] (or the scan signal SCAN[i]) may have a turn-off voltage level.

Since the first scan signal SCAN[1] provided at the fourth time point TP4 and the fifth time point TP5, e.g., the first scan signal SCAN[1] provided as a carry signal to the second stage ST2 (refer to FIG. 4), has a turn-off voltage level, the second scan signal SCAN[2] (or the scan signal SCAN[i+1])) may have a turn-off voltage level at the fifth time point T5 and the sixth time point T6.

Therefore, during one frame period, the scan driver 120 (refer to FIG. 1) does not output the scan signal having a turn-on voltage level, but may output only the scan signal having a turn-off voltage level. Because the stages ST1 to ST4 in the scan driver 120 do not perform a toggle operation of the scan signal during one frame period, power consumption can be reduced.

However, as the start signal FLM is masked, selective driving cannot be performed on some of the scan lines SL1 to SLn described with reference to FIG. 1 and the pixels corresponding to the scan lines SL1 to SLn.

Therefore, the display device 100 (refer to FIG. 1) according to exemplary embodiments of the inventive concept may perform masking on at least one of the first and second clock signals CLK1 and CLK2 instead of the start signal FLM, thus selectively driving some of the scan lines SL1 to SLn and the pixels corresponding to them.

Figure 8:
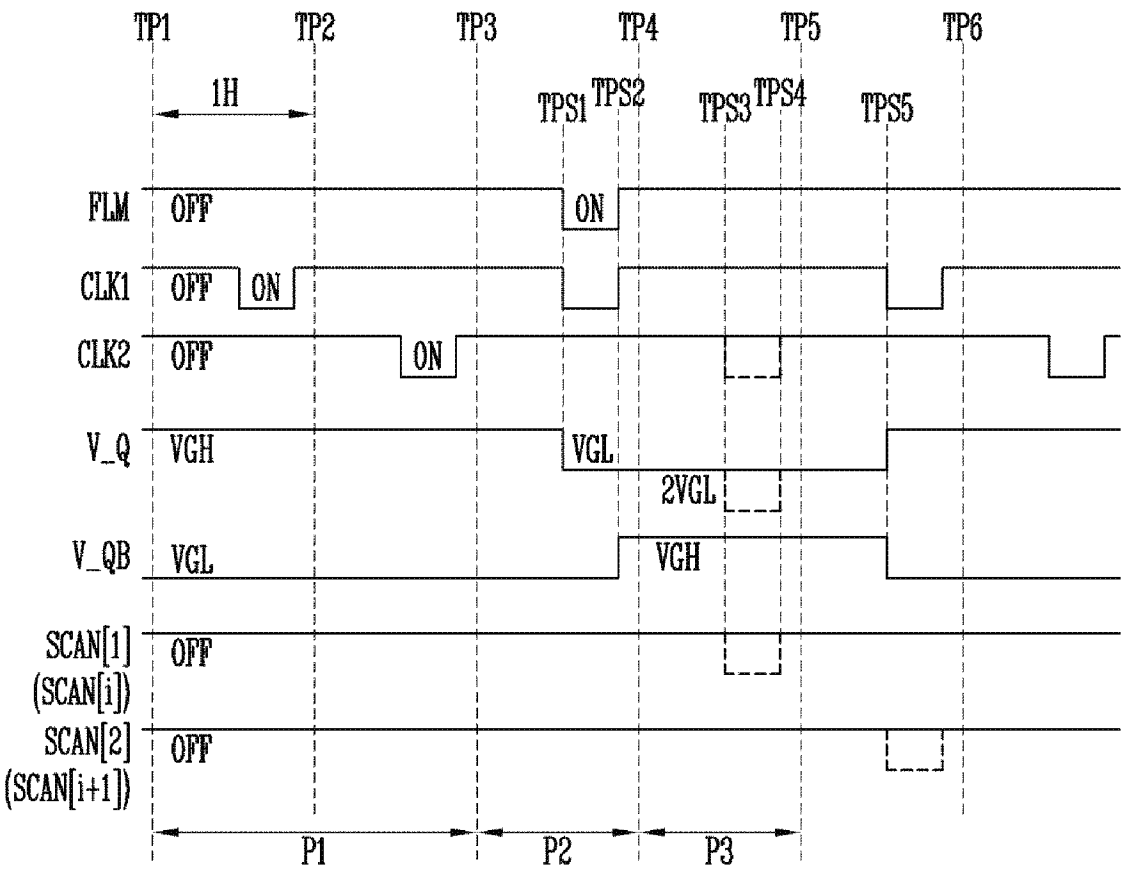
FIG. 8 is a waveform diagram of signals measured at the first stage of FIG. 5 according to an exemplary embodiment of the inventive concept.

FIG. 8 is a waveform diagram of signals measured at the first stage of FIG. 5 according to an exemplary embodiment of the inventive concept. FIG. 8 shows a waveform diagram that corresponds to the waveform diagram of FIG. 6, and the waveform diagram of FIG. 6 is shown by a dotted line.

Referring to FIG. 5, FIG. 6, and FIG. 8, in the period of time between the third time point TP3 and the fourth time point TP4, the start signal FLM may have a pulse having a turn-on voltage level. In other words, the timing controller 140 described with reference to FIG. 1 may normally output the start signal FLM. The first clock signal CLK1 may also have a pulse having a turn-on voltage level.

In this case, the first switching element M1 may be turned on in response to the first clock signal CLK1, and may transmit the start signal FLM to the first node Q. Therefore, the first node Q (V_Q) may have a turn-on voltage level (or the second voltage VGL) according to the start signal FLM.

The seventh switching element M7 may be turned on in response to a signal of the first node Q (V_Q), and pulls down the first scan signal SCAN[1] (or the scan signal SCAN[i]), and the second clock signal CLK2 may be output as the first scan signal SCAN[1].

However, because the second clock signal CLK2 has a turn-off voltage level, the first scan signal SCAN[1] may have a turn-off voltage level.

The first capacitor C1 may store a voltage difference between a turn-off voltage level and a turn-on voltage level according to the signal of the first node Q (V_Q) (or the voltage level of the first node Q) and the first scan signal SCAN[1].

The fifth switching element M5 may be turned on in response to the first clock signal CLK1, and may transmit the second voltage VGL to the second node QB. Therefore, the second node QB may have the second voltage VGL (or a turn-on voltage level).

In other words, in the second period of time P2, the first stage ST1 may prepare to output the first scan signal SCAN[1] in response to the start signal FLM (or the previous gate signal).

In the third period of time P3 between the fourth time point TP4 and the fifth time point TP5, the second clock signal CLK2 may be maintained at a turn-off voltage level instead of having a pulse having a turn-on voltage level.

For example, the timing controller 140 (refer to FIG. 1) may mask the second clock signal CLK2 in the third period of time P3 (e.g., the output period of the first stage ST1) corresponding to the first stage ST1, thus outputting the second clock signal CLK2 having a turn-off voltage level or cutting off the output of the second clock signal CLK2.

In this case, since the first capacitor C1 causes the first node Q (V_Q) to have a turn-on voltage level, the seventh switching element M7 may be maintained at a turn-on state in response to the signal of the first node Q (V_Q). Therefore, the first scan signal SCAN[1] may be maintained at a turn-off voltage level according to the second clock signal CLK2.

Subsequently, between the fifth time point TP5 and the sixth time point TP6, the first clock signal CLK1 may have a pulse having a turn-on voltage level.

In this case, the first switching element M1 is turned on in response to the first clock signal CLK1, and the first node Q may be connected to the first input terminal 101. Between the fifth time point TP5 and the sixth time point TP6, because the start signal FLM having a turn-off voltage level is applied to the first input terminal 101, the first node Q (V_Q) may be transitioned to a turn-off voltage level (or the first voltage VGH).

For reference, between the fifth time point TP5 and the sixth time point TP6, when the first clock signal CLK1 has a turn-off voltage level, the signal of the first node Q (V_Q) may be maintained at a turn-on voltage level (or the second voltage VGL). In this case, in the subsequent period of time (e.g., after the sixth time point TP6), the second clock signal CLK2 having a turn-on voltage level may be output as the first scan signal SCAN[1]. Therefore, when the second clock signal CLK2 is masked in the third period of time P3, the first clock signal CLK1 should have a pulse having a turn-on voltage level in a period of time immediately after the third period of time P3 (e.g., between the fifth time point TP5 to the sixth time point TP6).

Since the first scan signal SCAN[1] at the fourth time point TP4 and the fifth time point TP5, e.g., the first scan signal SCAN[1] provided as a carry signal to the second stage ST2 (refer to FIG. 4), has a turn-off voltage level, the second scan signal SCAN[2] (or the scan signal SCAN[i+1]) may have a turn-off voltage level at the fifth time point T5 and the sixth time point T6.

In other words, the display device 100 (or the timing controller 140)(refer to FIG. 1) may mask one of the first and second clock signals CLK1 and CLK2 to mask output (the scan signal or the carry signal) of the stage (e.g., the first stage ST1) corresponding to the masked clock signal.

Therefore, the scan driver 120 may not only output the scan signal during one frame period, but also selectively output the scan signal only to only some of the scan lines SL1 to SLn in a specific period of time within one frame period, and accordingly, selective driving for some pixels may be possible. For example, instead of masking the second clock signal CLK2 in the third period of time P3, when the first clock signal CLK1 is masked in a period of time between the fifth time point TP5 and the sixth time point TP6, the first scan signal SCAN[1] may have a turn-on voltage level, and the second scan signal SCAN[2] may have a turn-off voltage level. In other words, only the first scan line SL1 (refer to FIG. 1), to which the first scan signal SCAN[1], is applied may be selected.

Figure 9:
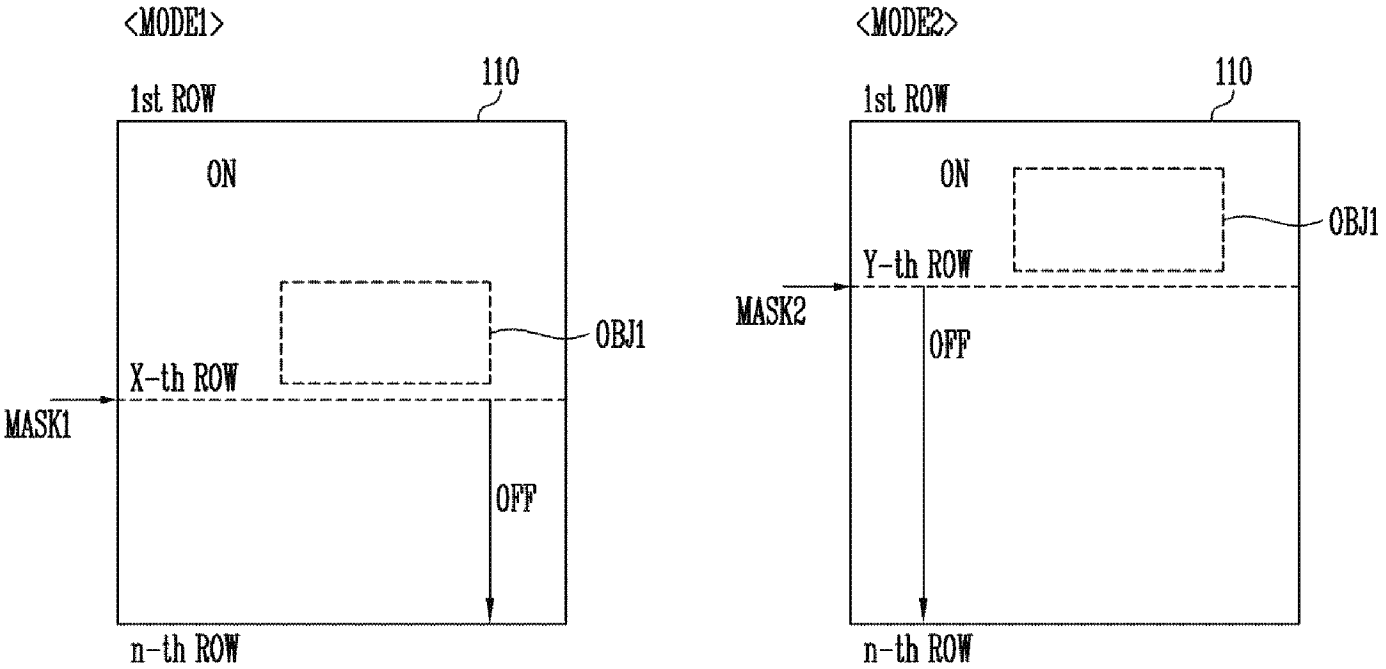
FIG. 9 shows an operation of a display device according to the waveform diagram of FIG. 8 according to an exemplary embodiment of the inventive concept.

FIG. 9 shows an operation of a display device according to the waveform diagram of FIG. 8 according to an exemplary embodiment of the inventive concept. In FIG. 9, an operation of the display device 100 in a first mode MODE1 (or a first frame period) and an operation of the display device 100 in a second mode MODE2 (or a second frame period) are shown.

Figure 10:
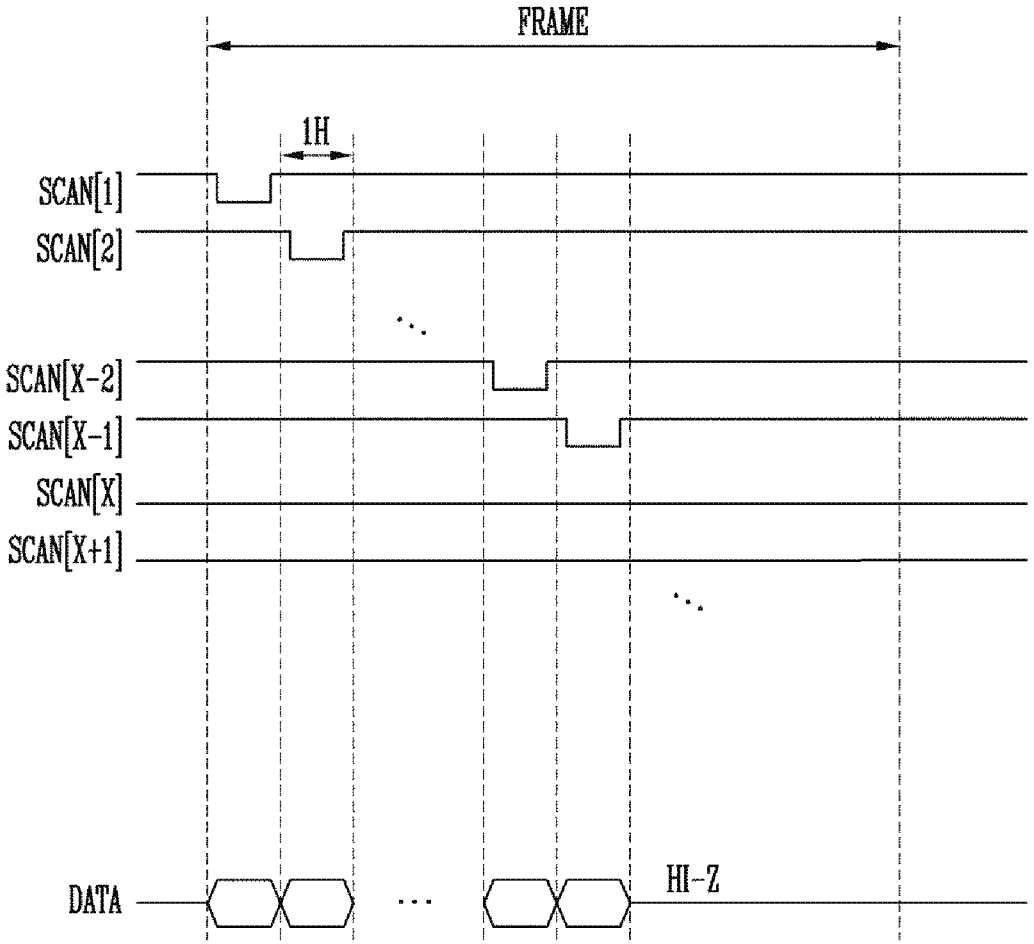
FIG. 10 is a waveform diagram of signals measured from the display device of FIG. 1 according to an exemplary embodiment of the inventive concept.

FIG. 10 is a waveform diagram of signals measured from the display device of FIG. 1 according to an exemplary embodiment of the inventive concept. In FIG. 10, scan signals and the data signal DATA according to the operation of the display device 100 in the first mode MODE1 are shown.

Referring to FIGS. 1, 8, and 9, in the first mode MODE1, the timing controller 140 may perform masking on at least one of the first and second clock signals CLK1 and CLK2 for an X-th row of the display unit 110 (where X is a positive integer). In other words, in the part of one frame period corresponding to the X-th row of one frame period, at least one of the first and second clock signals CLK1 and CLK2 may be maintained at a turn-off voltage level instead of having a pulse having a turn-on voltage level.

In this case, as shown in FIG. 10, for rows (or pixels PXL) from a first row of the display unit 110 to the X-th row, scan signals (e.g., first to X−1-th scan signals SCAN[1] to SCAN [X−1]) having a turn-on voltage level are sequentially provided from the scan driver 120, and for rows from the X-th row of the display unit 110 to an n-th row (e.g., the last row), scan signals from the scan driver 120 are not provided or scan signals (e.g., the X-th scan signal SCAN[X] and X+1-th scan signal SCAN[X+1]) having a turn-off voltage level may be provided.

When a frame image corresponding to one frame period includes a valid first object image OBJ1, and the other frame images except for the first object image OBJ1 are meaningless, e.g., when a valid image is displayed before the X-th row, the operation of the display device 100 according to the first mode MODE1 may be valid.

In an exemplary embodiment of the inventive concept, when at least one of the first and second clock signals CLK1 and CLK2 is masked for the X-th row of the display unit 110, the data driver 130 may cut off the output of the data signal in a period of time for the rows after the X-th row.

As shown in FIG. 10, for the first to the X−1-th rows, data signal DATA provided to the display unit 110 from the data driver 130 has a valid value, and for the rows after the X-th row, the data signal DATA may not have a valid value.

For example, in a period of time corresponding to rows after the X-th row in one frame period, the data driver 130 may increase impedance (to HI-Z) of output terminals (e.g., output terminals connected to data lines DL1 to DLm) of the data driver 130, or may cut off connection with the data lines DL1 to DLm.

Therefore, power consumption of the display device 100 may be further reduced.

In the second mode MODE2, the timing controller 140 may perform masking on at least one of the first and second clock signals CLK1 and CLK2 for a Y-th row (where Y is a positive integer) of the display unit 110. In other words, in the part of one frame period corresponding to the Y-th row in one frame period, at least one of the first and second clock signals CLK1 and CLK2 may be maintained at a turn-off voltage level instead of having a pulse having a turn-on voltage level.

In this case, for the rows (or pixels PXL) from the first row to the Y-th row of the display unit 110, scan signals having a turn-on voltage level are sequentially provided from the scan driver 120, and for rows from the Y-th row of the display unit 110 to the n-th row (e.g., the last row), scan signals are not provided from the scan driver 120, or scan signals having a turn-off voltage level may be provided.

When the frame image corresponding to one frame period includes the valid first object image OBJ1, the first object image OBJ1 may be displayed in an area before the Y-th row of the display unit 110.

A second position MASK2 (or a time point) of a period of time during which the first and second clock signals CLK1 and CLK2 are masked in the second mode MODE2 is different from a first position MASK1 of a period of time during which the first and second clock signals CLK1 and CLK2 are masked in the first mode MODEL In exemplary embodiments of the inventive concept, when the input data image DATA1 (refer to FIG. 1) in the first mode MODE1 (or the first frame period) and the input data image DATA1 in the second mode MODE2 (or the second frame period) are the same as or similar to each other (for example, when the input data image DATA1 in the second mode MODE2 includes the first object image OBJ1 that is disposed at the same position as that of the first object image OBJ1 included in the input data image DATA1 in the first mode MODE1), the data driver 130 may shift and output the input data image DATA1 in the second mode MODE2 based on a difference between the first position MASK1 (or the time point) where the first and second clock signals CLK1 and CLK2 are masked in the first mode MODE1 and the second position MASK2 where the first and second clock signals CLK1 and CLK2 are masked in the second mode MODE2.

For example, as shown in FIG. 9, the first object image OBJ1 to be displayed adjacent to the X-th row as in the first mode MODE1 may be shifted by a difference between the X-th row and the Y-th row, and may be displayed adjacent to the Y-th row.

For reference, when the first object image OBJ1 (for example, a clock image) is continuously displayed only in a specific area of the display unit 110, deterioration of the specific area can proceed faster than those of the other areas. Therefore, the first object image OBJ1 may be shifted to various positions and displayed as in the first mode MODE1, the second mode MODE2, or the like, thus preventing or mitigating the deterioration of the specific area of the display unit 110.

As described above with reference to FIG. 9 and FIG. 10, the display device 100 may adjust only a time point where at least one of the first and second clock signals CLK1 and CLK2 are masked, thus selectively driving some of the scan lines SL1 to SLn and some of the pixels PXL corresponding to them. The display device 100 (or the data driver 130) may cut off the output of the data signal for scan lines other than the selected scan lines SL1 to SLn. Therefore, power consumption of the display device 100 can be further reduced.

Figure 11:
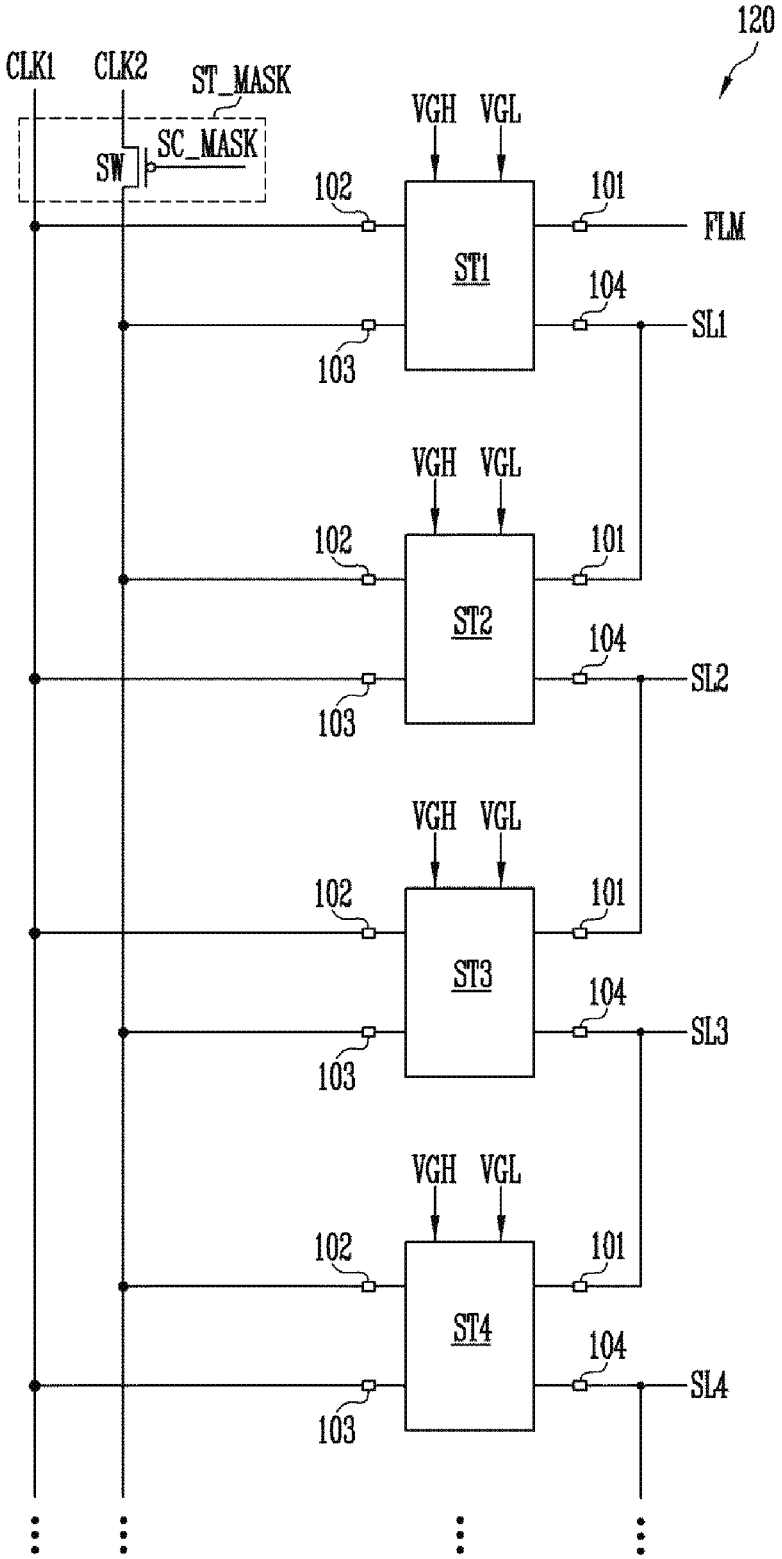
FIG. 11 is block diagram of a scan driver included in the display device of FIG. 1 according to an exemplary embodiment of the inventive concept.

FIG. 11 is block diagram of a scan driver included in display device of FIG. 1 according to an exemplary embodiment of the inventive concept.

Referring to FIG. 1, FIG. 4, and FIG. 11, the scan driver 120 in FIG. 11 is different from the scan driver 120 in FIG. 4 because it further includes a masking unit ST_MASK. Except for the masking unit ST_MASK, the scan driver 120 in FIG. 11 is substantially the same as or similar to the scan driver 120 in FIG. 4, so repetitive descriptions thereof will be omitted.

The masking unit ST_MASK respectively transmits the first clock signal CLK1 and the second clock signal CLK2 to the first clock signal line and the second clock signal line such that it can partially mask at least one of the first clock signal CLK1 and the second clock signal CLK2.

In an exemplary embodiment of the inventive concept, the masking unit ST_MASK may include a switching element SW. The switching element SW may include a first electrode that receives the second clock signal CLK2, a second electrode that is connected to the second clock signal line, and a gate electrode that receives a masking control signal SC_MASK. In this case, the masking control signal SC_MASK is provided from the outside (e.g., the timing controller 140 or the data driver 130), and has one pulse, for example, have a turn-on voltage level in the third period of time P3 described with reference to FIG. 8. For example, the masking control signal SC_MASK may be provided from the data driver 130 at a time point when cutting off the output of the data driver 130 as described with reference to FIG. 9 and FIG. 10, or may be the same as a control signal for cutting off the output of the data driver 130.

In this case, similar to the second clock signal CLK2 described with reference to FIG. 8, the first clock signal CLK1 provided to the stages ST1 to ST4 (refer to FIG. 4) may be masked on the switching element SW.

FIG. 11 shows that the switching element SW receives the second clock signal CLK2 to transmit it to the second clock signal line or cut it off, but the switching element SW is not limited thereto. For example, the first electrode of the switching element SW may be connected to the first voltage VGH (refer to FIG. 4) instead of receiving the second clock signal CLK2. When the switching element SW is turned on by the masking control signal SC_MASK, the first voltage VGH (or the voltage having a turn-off voltage level) is applied to the second clock signal line, and therefore, the second clock signal CLK2 may be maintained at a turn-off voltage level.

FIG. 11 shows that the masking unit ST_MASK includes one switching element SW, but the masking unit ST_MASK is not limited thereto. For example, similar to the switching element SW, the masking unit ST_MASK may further include an additional switching element that receives the first clock signal CLK1 to transmit it to the first clock signal line, and the additional switching element may be operated in response to the masking control signal SC_MASK or another control signal.

As described above, the display device and the scan driver according to exemplary embodiments of the inventive concept may mask the output of the stage corresponding to a masked clock signal, e.g., the scan signal (or carry signal), by masking one of the clock signals in a part of the first frame period. Therefore, the display device can drive a part of the display panel and reduce power consumption even without an additional circuit configuration.

In addition, the display device can further reduce power consumption by increasing impedance of the output terminal of the data driver or cutting off the output in the part of the first frame period.

While the inventive concept has been shown and described with reference to exemplary embodiments thereof, it will be apparent to those of ordinary skill in the art that various changes in form and details may be made thereto without departing from the spirit and scope of the inventive concept as set forth by the appended claims.

What is claimed is:

1. A display device comprising:

a timing controller configured to generate a clock signal, a start signal, and image data;

a scan driver including a plurality of stages configured to sequentially output the clock signal as a scan signal in response to the start signal;

a data driver configured to generate a data signal using, the image data; and a display unit including pixels configured to emit light with a luminance corresponding to the data signal in response to the scan signal, wherein the timing controller performs masking on the clock signal in a part of a first frame period during which the scan driver sequentially outputs the scan signal so that some of the pixels are selectively driven, wherein the timing controller performs masking on the clock signal in a first period of the first frame period, and performs masking on the clock si anal in a second period of the second frame period, and wherein a first position of the second period of the second frame period is different from a second position of the first period of the first frame period.

2. The display device of claim 1, wherein each of the plurality of stages outputs the clock signal as the scan signal in response to a carry signal, wherein a first stage of the plurality of stages receives the start signal as the carry signal, and wherein stages other than the first stage of the plurality of stages receive a scan signal of a previous stage as the carry signal.

3. The display device of claim 2, wherein the clock signal includes a first clock signal and a second clock signal, wherein the first clock signal has a pulse waveform, and wherein the second clock signal is a signal in which the first clock signal is shifted by a half-cycle.

4. The display device of claim 3, wherein the first stage outputs the second clock signal as the scan signal, wherein a second stage of the plurality of stages outputs the first clock signal as the scan signal, and wherein the second stage is adjacent to the first stage.

5. The display device of claim 3, wherein the timing controller performs masking on at least one of the first clock signal and the second clock signal in the part of the first frame period.

6. The display device of claim 5, wherein the timing controller performs masking on the second clock signal, and does not perform masking on the first clock signal in the part of the first frame period.

7. The display device of claim 6, wherein the second clock signal has a pulse having a first voltage level between a first time point and a second time point, wherein the second clock signal is maintained at a second voltage level that is different from the first voltage level between a third time point and a fourth time point, wherein the first time point, the second time point, the third time point, and the fourth time point are sequentially separated by a half-cycle of the second clock signal, and wherein the third time point and the fourth time point are included in the part of the first frame period.

8. The display device of claim 7, wherein the first clock signal has a pulse having the first voltage level between the second time point and the third time point and a pulse having the first voltage level between the fourth time point and a fifth time point, and the fifth time point is separated from the fourth time point by a half-cycle of the first clock signal.

9. The display device of claim 5, wherein the part of the first frame period corresponds to at least one of the plurality of stages.

10. The display device of claim 9, wherein the part of the first frame period is smaller than a cycle of the first clock signal.

11. The display device of claim 9, wherein the at least one of the plurality of stages outputs the scan signal having a turn-off voltage level, wherein the turn-off voltage level is a voltage level that turns off a transistor included in each of the pixels, and wherein the transistor is configured to receive the scan signal.

12. The display device of claim 3, wherein the first stage includes:

a first node controller configured to transmit the carry signal to a first node in response to the first clock signal and the second clock signal; and a buffer unit configured to output the second clock signal as the scan signal in response to a first node voltage of the first node.

13. The display device of claim 12, wherein the first stage further includes:

a second node controller configured to transmit the first clock signal to a second node in response to the first node voltage of the first node, wherein the buffer unit transitions a voltage level of the scan signal to a turn-off voltage level m response to a second node voltage of the second node.

14. The display device of claim 1, wherein the timing controller shifts and outputs the image data based on a difference between the first position and the second position.

15. The display device of claim 1, wherein the data driver cuts off output of the data signal in the other part of the first frame period after the part of the first frame period.

16. A scan driver comprising:

a first clock signal line;

a second clock signal line;

a masking unit configured to transmit a first clock signal and a second clock signal to the first chick signal line and the second clock signal line, respectively, wherein the masking unit partially performs masking on at least one of the first clock signal and the second clock signal; and a plurality of stages connected to the first clock signal line and the second clock signal line, and configured to sequentially output a scan signal using the first clock signal and the second clock signal, wherein each of the plurality of stages outputs one of the first clock signal and the second clock signal as the scan signal in response to a carry signal, and wherein each of the plurality of stages receives a scan signal of a previous stage as the carry signal.

17. The scan driver of claim 16, wherein the masking unit includes a switching element including a first electrode, a second electrode, and a gate electrode, and wherein the first electrode receives the second clock signal, the second electrode is connected to the second clock signal line, and the gate electrode receives a masking control signal.

18. A method of operating a display device, the method comprising:

outputting, to a scan driver, a first clock signal and a second clock signal, wherein the first dock signal has a pulse waveform and the second clock signal is a signal in which the first clock signal is shifted by a half-cycle, controlling, by a timing controller, the second clock signal to have a pulse having a first voltage level between a first time point and a second time point;

controlling, by the timing controller, the first clock signal to have a pulse having the first voltage level between the second time point and a third time point;

masking, by the timing controller, the second clock signal to maintain the second clock signal at a second voltage level that is different from the first voltage level between the third time point and a fourth time point; and controlling, by the timing controller, the first clock signal to have a pulse having the first voltage level between the fourth time point and a fifth time point, wherein the first time point, the second time point, the third time point, the fourth time point, and the fifth time point are sequentially separated by a half-cycle of the first clock signal.

19. The method of claim 18, wherein a scan signal output by the scan driver is maintained at a turn-off voltage level in response to the second clock signal between the third time point and the fourth time point.

* * * * *